United States Patent [19]

Tohma et al.

[11] 4,196,022

[45] Apr. 1, 1980

[54] SURFACE HARDENING METHOD

[75] Inventors: Teruo Tohma; Toshikazu Yoshino; Tsunehiro Tsukagoshi, all of Tokyo, Japan

[73] Assignee: Pioneer Electronic Corporation, Tokyo, Japan

[21] Appl. No.: 861,322

[22] Filed: Dec. 16, 1977

[30] Foreign Application Priority Data

Dec. 21, 1976 [JP] Japan ..... 51-152871

[51] Int. Cl.[2] ..... C23C 9/02; C23C 9/04

[52] U.S. Cl. ..... 148/6; 427/250; 427/248.1

[58] Field of Search ..... 427/253, 250, 229; 423/298; 75/84.5, 84.4; 148/6, 6.3

[56] References Cited

U.S. PATENT DOCUMENTS

| | | | |
|---|---|---|---|
| 1,306,568 | 6/1919 | Weintraub | 423/298 |
| 2,854,353 | 9/1958 | Schwope | 427/253 |
| 2,858,600 | 11/1958 | Vigor | 427/398 D |
| 3,051,587 | 8/1962 | Coburn | 427/329 |
| 3,058,841 | 10/1962 | Drosten et al. | 427/253 |
| 3,211,572 | 10/1965 | Globus | 427/253 |
| 3,321,337 | 5/1967 | Patterson | 148/6.3 |

FOREIGN PATENT DOCUMENTS

| | | | |
|---|---|---|---|
| 343875 | 2/1931 | United Kingdom | 427/253 |

OTHER PUBLICATIONS vanArkel, Mettalwirtschaft, 13, 405–408 (1934).

Powell et al., Vapor-Plating, John Wiley & Sons 1955, pp. 46–52, 60–70.

*Primary Examiner*—Ralph S. Kendall

*Attorney, Agent, or Firm*—Sughrue, Rothwell, Mion, Zinn and Macpeak

[57] ABSTRACT

A method of surface hardening a substrate made of an inorganic material by diffusing a different inorganic material into the substrate is disclosed wherein the diffusion is effected in an alkali metal gas atmosphere. The substrate may be made of titanium, zirconium, iron, yttrium, tungsten, tantalum or a material containing one of those elements as a principle component. The diffusion material may be boron, silicon or a material containing one of those elements. The alkali metal gas atmosphere is produced by heating metallic sodium, potassium, lithium or a combination thereof. The surface hardened substrate produced according to the method exhibits an increased Young's modulus of elasticity, hardness and mechanical strength and is particularly suitable in the manufacture of electro-acoustic diaphragms as well as other light weight, high mechanical strength articles.

15 Claims, 5 Drawing Figures

SURFACE HARDENING METHOD

BACKGROUND OF THE INVENTION

This invention relates to a surface hardening method employed for diaphragms in electro-acoustical equipment, precision instruments such as for instance clocks, automobile parts, aircraft parts, etc.

Metallic materials such as aluminum, titanium or the like which are light in weight and readily rolled are extensively employed in the above-described fields. However, in the case of the diaphragm of electro-acoustic equipment, because of the material, a particular vibration mode is caused throughout the diaphragm while the high frequency characteristic suffers from the generation of a great peak, which considerably lowers the tonal quality thereof. In the case of a cantilever as used for example in a phono cartridge, a major part of the effective mass of the vibration system is occupied by the cantilever, and therefore it is very difficult to reduce the effective mass of the vibration system to improve the performance of the cartridge. In other words, if the wall thickness and diameter of the pipe is reduced to reduce the weight of the cantilever, its rigidity is decreased and the frequency characteristic thereof is lowered. This is one of the disadvantages accompanying the conventional materials.

Elimination of this disadvantage may be achieved by using a material in which the ratio of Young's modulus of elasticity E to density ($E/\rho$, hereinafter referred to as "a modulus of ratio elasticity" when applicable) is high. Boron, beryllium, etc. are available as materials having a high modulus of ratio elasticity $E/\rho$. However, boron is not so readily available. In manufacturing beryllium of high quality, it is necessary to spend a lot of money for pollution prevention. In addition, it is difficult to roll or press boron or beryllium, and therefore it is expensive to form it as desired and the configuration thereof is greatly limited.

Therefore, a method has been considered in which a material such as aluminum or titanium which can be readily shaped as desired in advance, and the material thus shaped is employed as a substrate which is coated with boron or beryllium by physical vacuum evaporation or chemical treatment, thus obtaining the diaphragm, the cantilever, or the like. In the case of forming the coating layer on the substrate by physical vacuum evaporation or chemical treatment, it is preferable to heat the substrate at a temperature higher than 150° C. to improve the characteristic of the vacuum-evaporated film. However, in this case, since the coefficient of thermal expansion of the substrate is greatly different from that of the coating layer, the coating layer may be cracked with the result that it sometimes becomes useless.

There has also been proposed a method in which a coating layer or beryllium or boron is formed on the substrate by vacuum evaporation or the like, and only the coating layer is allowed to peel off the substrate thereby to manufacture a diaphragm of beryllium or boron. However, the coating layer of beryllium or boron manufactured by vacuum evaporation or the like is brittle and low in mechanical strength. Furthermore, in order to form the coating layer on the substrate by vacuum evaporation or the like, it is necessary to provide an evaporation device such as an electron beam heating device which is expensible, and in addition the manufacturing period of time is relatively long, which leads to an increase in manufacturing cost.

In order to overcome these difficulties, a surface hardening method in which a coating layer is boron is formed on the substrate and is then subjected to heat treatment thereby diffusing the boron into the substrate has been proposed. A specific feature of this surface hardening method is the formation of a diffusion layer in the substrate. However, in the formation of the diffusion layer, a coating layer of diffusion material for forming the diffusion layer is formed on the substrate by physical vacuum evaporation or chemical treatment, and therefore it is necessary to provide expensive devices for forming the diffusion layer on the substrate. Furthermore, in the case where the coating layer which is to form the diffusion layer is of a material such as boron, the processing of which is very difficult, it takes a relatively long period of time to form the coating layer, which leads to an increase in manufacturing cost.

In view of the above-described facts, the applicants have practiced a method in which a titanium substrate is embedded in boride powder containing boron and is then subjected to heat treatment to diffuse boron into the substrate, thereby increasing the Young's modulus thereof. However, in this method the reaction time is very long, and therefore the efficiency is low. In addition, even if the process is effected in a vacuum on the order of $10^{-5}$ Torr., the substrate becomes brittle due to oxidation and accordingly a significant increase in the Young's modulus of elasticity has hardly been observed.

SUMMARY OF THE INVENTION

Accordingly, an object of this invention is to eliminate the above-described difficulties accompanying the conventional methods. More specifically, an object of the invention is to provide a surface hardening method in which a diffusion material different in properties from a substrate made of inorganic material is quickly diffused into the substrate in an alkali metal gas atmosphere, whereby the surfaces of the substrate are protected from oxidization, and it is possible to increase the Young's modulus of elasticity, hardness, and mechanical strength thereof.

BRIEF DESCRIPTION OF THE DRAWINGS

Now, the invention will be described in detail with reference to the accompanying drawings in which.

DETAILED DESCRIPTION OF THE INVENTION

Figure 1:
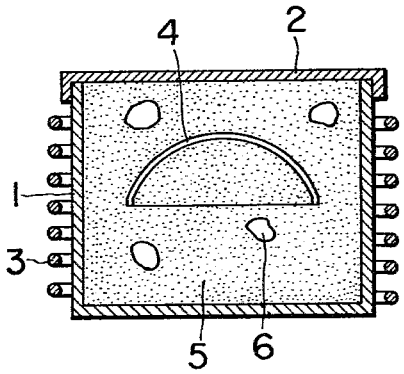
FIGS. 1 through 5 are cross-sectional views illustrating furnace structures and variations in the practice of the surface hardening method according to the invention.

Referring now to the drawings and in particular to FIG. 1, a furnace 1 is made of a heat-resisting material such as carbon or alumina, and a cover 2 is made of the same material as that of the furnace and placed over the furnace to seal the latter. A heater 3 is wound around the furnace 1. A substrate 4 made of a material whose principle component is inorganic metal is positioned within the furnace. Titanium, or a material containing titanium; zirconium, or a material containing zirconium; iron, or a material containing iron; yttrium, or a material containing yttrium; tungsten, or a material containing tungsten; or tantalum, or a material containing tantalum may be employed as a material forming the substrate 4. A diffusion material 5 which is to be diffused in the substrate 4 is made of an inorganic material different from the material of the substrate 4. Boron powder or silicon powder may be employed as the material of the inorganic material forming the diffusion material 5. An alkali metal gas generating material 6 is distributed throughout the diffusion material 5. By heating this material 6, the container 1 is filled with an alkali metal gas atmosphere. Metallic sodium, metallic potassium, metallic lithium, or combinations of these materials may be employed as the alkali metal gas generating material 6.

In practicing this invention with the apparatus shown in FIG. 1, the substrate 4 made of inorganic material is embedded in the furnace 1 filled with the diffusion material 5 different in quality from the substrate 4, and then the furnace 1 is sealed by covering it with the cover 2. Then, the furnace 1 is heated by means of the heater 3 so as to subject the alkali metal gas generating material 6 mixed in the diffusion material 5 to its heat of decomposition, whereby the furnace 1 is filled with the alkali metal gas atmosphere and the diffusion material 5 is diffused into the substrate 4 in the alkali metal gas atmosphere. This is a specific feature of the surface hardening method according to this invention.

Thus, as is apparent from the above description, the alkali metal gas generating material 6 mixed in the diffusion material 5 to be diffused into the substrate 4 made of inorganic material is evaporated by heating the furnace 1 so that the furnace 1 is filled with the alkali metal gas atmosphere. Under this alkali metal gas atmosphere, if the furnace 1 is heated (preferably at a temperature of 90° to 1200° C.), the diffusion material 5 is activated, and this activated diffusion material 5 can be diffused, in the surface of the substrate 4 made of inorganic material without oxidation because of the reduction action of the alkali metal gas. It is desirable that the furnace 1 is evacuated to approximately $10^{-4}$ Torr. and the moisture and adsorption gas contained in the diffusion material 5 are removed therefrom. Thus, according to the surface hardening method according to this invention, oxidization of the surface of the substrate 4 can be prevented, and it is possible to diffuse the diffusion material 5 such as boron into the surfaces of the substrate 4. Therefore, it is possible to obtain the substrate 4 made of inorganic material, which is high in Young's modulus of elasticity and hardness and has a high mechanical strength.

Figure 2:
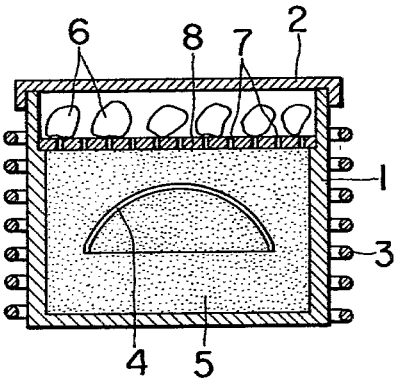

Shown in FIG. 2 is an apparatus for another embodiment of this invention. In this apparatus, in order to place the diffusion material 5 and the alkali metal gas generating material 6 separately in the furnace 1, a separating plate 8 having a number of gas passing holes 7 is provided in the furnace 1 in such a manner as to divide the furnace into two chambers. The alkali metal gas generating material 6 are placed on the separating plate 8, while the diffusion material 5 is placed below the separating plate 8. Only in this point is the apparatus shown in FIG. 2 different from the apparatus shown in FIG. 1.

When the furnace 1 is heated, the alkali metal gas is generated by the alkali metal gas generating material 6, as a result of which the gas passes through the gas passing holes 7 in the separating plate and fills the furnace 1. Therefore, the diffusion material is activated, and the diffusion material thus activated is diffused into the surfaces of the substrate 4 while oxidization of the substrate 4 is prevented. Thus, in this embodiment, the alkali metal gas generating materials 6 are placed on the separating plate 8 so as not to be in direct contact with the substrate 4, and therefore corrosion of the substrate 4 due to the strong reaction of the alkali metal gas generating materials 6 can also be prevented.

Figure 3:
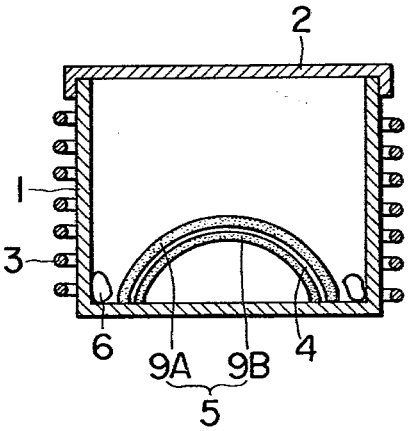

A third embodiment of this invention will be described with reference to FIG. 3. The third embodiment is different from the first embodiment only in that coating layers 9A and 9B made of the diffusion material 5 are formed on the surfaces of the substrate 4. For forming these coating layers 9A and 9B, the diffusion material in a powder state is mixed with acetone, for instance, to prepare a suspension. The suspension thus prepared is applied onto the surfaces of the substrate 4 by spraying, to form the coating layers. In addition to this method, an electrostatic coating method, a powder coating method, or an electrophoresis method may be employed for forming the coating layers.

Similarly as in the cases described above, when the furnace 1 is heated, the diffusion material 5 is diffused into the surfaces of the substrate 4. However, it should be noted that, while in the first and second embodiments the furnace 1 is filled with the diffusion material 5, in the third embodiment the coating layers 9A and 9B of the diffusion material 5 are merely formed. Therefore, in this embodiment, the amount of the diffusion material 5 used is less. Furthermore, as the coating layers 9A and 9B are formed directly on the surfaces of the substrate 4, the loss of the diffusion material 5 is also less, and the diffusion can be effected into the surfaces of the substrate positively and quickly.

Figure 4:
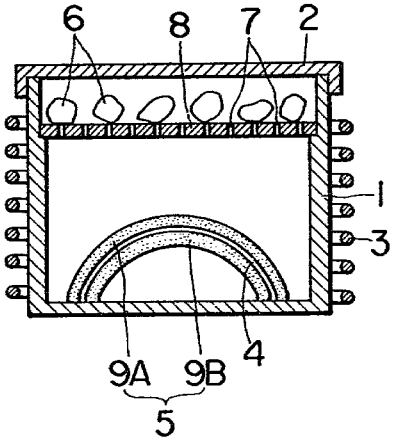

A fourth embodiment of this invention will be described with reference to FIG. 4. The apparatus itself in this embodiment is similar to the apparatus shown in FIG. 2 of the second embodiment, and the fourth embodiment is similar to the third embodiment in that the coating layer 9A and 9B made of the diffusion material 5 are employed. In this embodiment, the alkali metal gas generating materials 6 are placed on the separating plate 8 so as not to be in direct contact with the substrate 4, as a result of which corrosion of the substrate 4 is prevented. In addition, as the coating layers 9A and 9B are formed on the surfaces of the substrate 4, the amount of the diffusion material 5 used is less than those in the first and second embodiments, and the diffusion material 5 can be positively and quickly diffused into the surfaces of the substrate 4 without loss.

Incidentally, in the case where metallic sodium is employed as the alkali metal gas generating material 6, and the furnace 1 is filled with the alkali metal gas by heating the furnace 1 with the heater 3, from the beginning an evaporation phenomenon takes place so as to maintain the inside of the furnace under the alkali metal gas atmosphere, as a result of which the diffusion material is activated and the surfaces of the substrate are protected from oxidization. However, as the material 6 is gasified in its entirety in a short period of time, if a long period of time is necessary for processing, then the amount of metallic sodium gas becomes less in the furnace 1. Accordingly, its function as an accelerator for the diffusion material 5 is lowered, and it becomes difficult to sufficiently protect the substrate 4 from oxidization.

Figure 5:
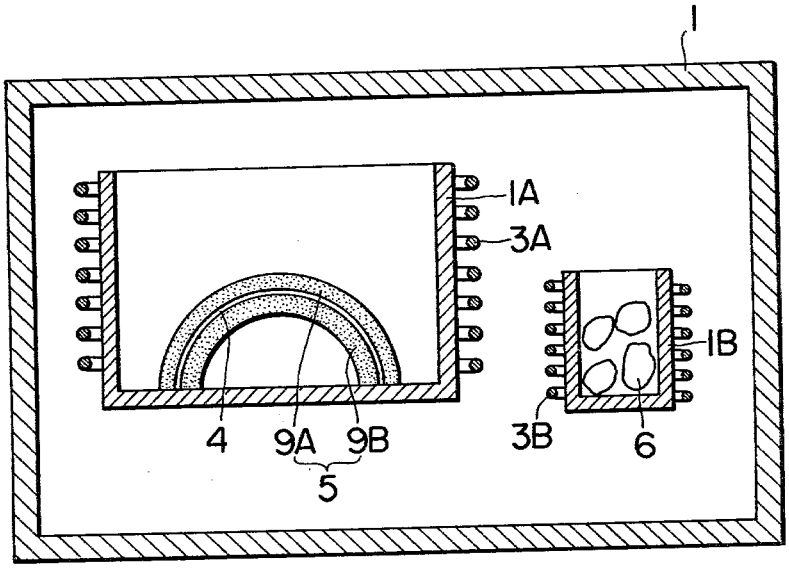

In order to prevent the lowering in function of metallic sodium as described above, a fifth embodiment of this invention is proposed, as shown in FIG. 5. In FIG. 5, reference characters 1A and 1B designate inner furnaces provided in a furnace 1 for respectively accommodating a substrate 4 and alkali metal gas generating materials 6 (in this example, metallic sodium being employed), and reference characters 3A and 3B designate heaters wound around the inner furnaces 1A and 1B, respectively. With exception of these elements, the arrangement of the apparatus in the fifth embodiment is similar to that in the third embodiment. Since the heaters 3A and 3B are wound around the inner furnace 1A for accommodating the substrate 4 and the inner furnace 1B for accommodating the alkali metal gas generating material 6, respectively, the heating temperatures of the furnaces 1A and 1B by the heaters 3A and 3B can be separately (individually) controlled. Thus, the alkali metal gas generating material 6 placed in the inner furnace 1B is evaporated by heating the inner furnace 1B with the heater 3B, as a result of which the inside of the furnace 1A is maintained under the alkali metal gas atmosphere. In the case where the alkali metal gas generating material 6 is metallic sodium, a large amount of gas is provided through evaporation immediately when the furnace 1B is heated, and the density therein is increased. Therefore, the heating operation of the heater 3B is controlled so that the generation of the alkali metal gas is maintained and its density is maintained unchanged until the diffusion material 5 is completely diffused into the surfaces of the substrate 4.

In this embodiment, the processing period of time from the instant when the alkali metal gas is generated by the alkali metal gas generating material 6 to the time when the diffusion material 5 is diffused into the surfaces of the substrate 4 is somewhat larger. However, as the function as an accelerator for the diffusion material 5 is maintained unchanged and oxidization of the surface of the substrate 4 can be prevented by the alkali metal gas, it is possible to effectively diffuse the diffusion material 5 into the surfaces of the substrate 4.

In another embodiment of this invention, instead of the metallic sodium, a mixture of metallic sodium and metallic lithium mixed in the ratio of 1 to 1 is placed, as the alkali metal gas generating material 6, in the furnace 1. In this case, the vapor pressure of the metallic lithium is approximately $1/10^3$ of that of the metallic sodium, and therefore the amount of evaporation is less, but the gas is maintained for a relatively long period of time. This is due to the following reasons. The metallic sodium is higher in activity than the metallic lithium. In addition, the metallic sodium is gasified greatly in a short period of time so that it is combined with the steam, oxygen and other gases in the furnace 1, as a result of which oxidization of the surfaces of the substrate is prevented and in addition the diffusion material 5 is activated. Therefore, the metallic lithium is evaporated so as to maintain the inside of the furnace 1 under the alkali metal gas atmosphere, thus performing the same function. The same effect can be obtained from the combination of metallic potassium and metallic lithium, because the vapor pressure of the metallic lithium is approximately $1/10^3$ of that of the metallic potassium, and the metallic lithium is higher in activity than the metallic potassium.

According to the above-described various embodiments of this invention, it is possible to quickly diffuse the diffusion material having properties different from those of the substrate made of inorganic material into the substrate under the alkali metal gas atmosphere in a short period of time, and it is also possible to protect the surfaces of the substrate from oxidization. Therefore, it is possible to provide a substrate which is high in Young's modulus of elasticity and hardness and is greater in mechanical strength. Furthermore, according to this invention, the number of steps is relatively small, and the construction of the apparatus for practicing the invention is simple. Accordingly, the cost of equipment is low, which leads to a low manufacturing cost.

What is claimed is:

1. In a surface hardening method wherein a diffusion material is diffused into a substrate made of inorganic material by heating said diffusion material and said substrate, said diffusion material made of an inorganic material different in properties from said substrate, the improvement wherein the step of heating for diffusing said diffusion material is effected in an alkali metal gas atmosphere with the diffusion material in the form of a powder and the alkali metal gas in contact with said substrate.

2. A surface hardening method as claimed in claim 1, in which said substrate is made of titanium or a material containing titanium as a principle component thereof.

3. A surface hardening method as claimed in claim 1, in which said substrate is made of zirconium or a material containing zirconium as a principle component thereof.

4. A surface hardening method as claimed in claim 1, in which said substrate is made of iron or a material containing iron as a principle component thereof.

5. A surface hardening method as claimed in claim 1, in which said substrate is made of yttrium or a material containing yttrium as a principle component thereof.

6. A surface hardening method as claimed in claim 1, in which said substrate is made of tungsten or a material containing tungsten as a principle component thereof.

7. A surface hardening method as claimed in claim 1, in which said substrate is made of tantalum or a material containing tantalum as a principal component thereof.

8. A surface hardening method as claimed in claim 1, wherein said alkali metal gas atmosphere is a gas obtained by heating metallic sodium.

9. A surface hardening method as claimed in claim 1, wherein said alkali metal gas atmosphere is a gas obtained by heating metallic potassium.

10. A surface hardening method as claimed in claim 1, wherein said alkali metal gas atmosphere is a gas obtained by heating metallic lithium.

11. A surface hardening method as claimed in claim 1, wherein said alkali metal gas atmosphere is a gas obtained by heating metallic sodium and metallic lithium simultaneously.

12. A surface hardening method as claimed in claim 1, wherein said alkali metal gas atmosphere is a gas obtained by heating metallic potassium and metallic sodium simultaneously.

13. A surface hardening method as claimed in claim 1, wherein the step of heating includes the step of controlling the gas generating temperature for said alkali metal gas atmosphere independently of the temperature for diffusing said diffusion material into said substrate.

14. A surface hardening method as claimed in claim 1, in which said diffusion material is boron or a material containing boron.

15. A surface hardening method as claimed in claim 1, in which said diffusion material is silicon or a material containing silicon.

* * * * *